US005941684A

United States Patent [19]

Parker

[11] Patent Number: 5,941,684

[45] Date of Patent: Aug. 24, 1999

[54] VARIABLE GEOMETRY TURBINE

[75] Inventor: John Frederick Parker, Huddersfield, United Kingdom

[73] Assignee: Holset Engineering Company Ltd., Huddersfield, United Kingdom

[21] Appl. No.: 09/095,339

[22] Filed: Jun. 10, 1998

[30] Foreign Application Priority Data

Jun. 10, 1997 [GB] United Kingdom ..... 9711897

[51] Int. Cl.[6] ..... F01B 25/02; F03B 1/04

[52] U.S. Cl. ..... 415/156; 415/158

[58] Field of Search ..... 415/150, 151, 415/156, 155, 157, 158, 149.4

[56] References Cited

U.S. PATENT DOCUMENTS

| | | | |
|---|---|---|---|
| 2,957,424 | 10/1960 | Brundage et al. | 415/158 X |
| 3,749,513 | 7/1973 | Chute | 415/158 X |
| 4,415,307 | 11/1983 | Fortmann | 415/158 X |
| 4,416,583 | 11/1983 | Byrns | 415/148 |
| 4,557,665 | 12/1985 | Szczupak | 415/158 |
| 4,657,481 | 4/1987 | Mowill et al. | 415/158 X |
| 4,844,690 | 7/1989 | DeLaurier et al. | 415/148 |
| 5,044,880 | 9/1991 | McKean | 415/158 |
| 5,183,381 | 2/1993 | McKean | 415/155 X |
| 5,522,697 | 6/1996 | Parker et al. | 415/158 |

FOREIGN PATENT DOCUMENTS

| | | | |
|---|---|---|---|
| 1061028 | 9/1955 | Germany | 415/156 |
| 353837 | 6/1961 | Sweden | 415/158 |

*Primary Examiner*—John E. Ryznic
*Attorney, Agent, or Firm*—Gary M. Gron

[57] ABSTRACT

A variable geometry turbine comprising a housing, a turbine wheel mounted to rotate about a pre-determined axis within the housing, and a gas inlet passage to the turbine. The gas inlet passage is defined between a fixed wall and an annular sidewall which is mounted in the housing and is displaceable relative to the fixed wall between axially spaced first and second positions. The sidewall is biased away from the fixed by at least one spring towards the first position, an axial force is applied to the sidewall in opposition to the spring to thereby control the axial position of the sidewall. The spring or springs provide a non-linear length to spring force characteristics such that the resultant of the applied spring force and an axial force applied to the sidewall as a result of gas flow through the passage increases continuously as the sidewall is displaced from the first position to the second position.

7 Claims, 4 Drawing Sheets

Prior Art

Prior Art

VARIABLE GEOMETRY TURBINE

TECHNICAL FIELD

The present invention relates to a variable geometry turbine incorporating a displaceable turbine inlet passage sidewall.

BACKGROUND OF THE INVENTION

U.S. Pat. No. 5,522,697 describes a known variable geometry turbine in which a turbine wheel is mounted to rotate about a pre-determined axis within a housing. An inlet passage to the turbine wheel is defined between a fixed wall of the housing and a sidewall which is displaceable relative to the fixed wall in order to control the width of an inlet passage. The sidewall is supported on rods extending parallel to the wheel rotation axis, and the rods are axially displaced relative to the housing so as to control the position adopted by the sidewall.

The rods are displaced by a pneumatic actuator mounted on the outside of the housing, the pneumatic actuator driving a piston. The actuator piston is coupled to a lever extending from a shaft pivotally supported by the housing such that displacement of the lever causes the shaft to turn. A yoke having two spaced apart arms is mounted on the shaft in a cavity defined within the housing. The end of each arm of the yoke is received in a slot in a respective sidewall support rod. Displacement of the actuator piston causes the arms to pivot and to drive the sidewall in the axial direction as a result of the interengagement between the arms and the sidewall support rods.

In a co-pending application with the same priority date as this application, a variable geometry turbine is described in which the external actuator mechanically coupled to the sidewall is replaced by a piston and cylinder arrangement within the housing. Problems have been experienced in controlling the axial position of the sidewall with both the conventional external actuator arrangements and arrangements relying upon a piston and cylinder within the housing. In particular, the sidewall has proved difficult to control as it approaches a fully closed position, that is a position in which the width of the turbine inlet passage is a minimum.

SUMMARY OF THE INVENTION

It is an object of the present invention to obviate or mitigate the problems outlined above.

According to the present invention, there is provided a variable geometry turbine comprising a housing, a turbine wheel mounted to rotate about a pre-determined axis within the housing, a gas inlet passage to the turbine defined between a fixed wall and an annular sidewall which is mounted in the housing and is displaceable relative to the fixed wall between axially spaced first and second positions, at least one spring biasing the sidewall away from the fixed wall towards the first position, and means for applying an axial force to the sidewall in opposition to the at least one spring to thereby control the axial position of the sidewall, wherein the said at least one spring has a non-linear length to spring force characteristics such that the resultant of the applied spring force and an axial force applied to the sidewall as a result of gas flow through the passage increases continuously as the sidewall is displaced from the first position to the second position.

The rate of change of spring force with sidewall displacement may increase as the sidewall is displaced from the first position to the second position. The spring force may be provided by one or more springs the or each of which has a non-linear length to spring force characteristic or by two or more springs each having a linear length to spring force characteristic but being arranged to deliver a resultant spring force which is non-linear.

The sidewall may be mounted on support rods extending parallel to the wheel axis, the support rods being active upon directly by the or each spring or being coupled to an external actuator which incorporates the or each spring.

SUMMARY OF THE DRAWINGS

Embodiments of the present invention will now be described, by way of example, with reference to the accompanying drawings, in which.

DESCRIPTION OF THE INVENTION

Figure 1:
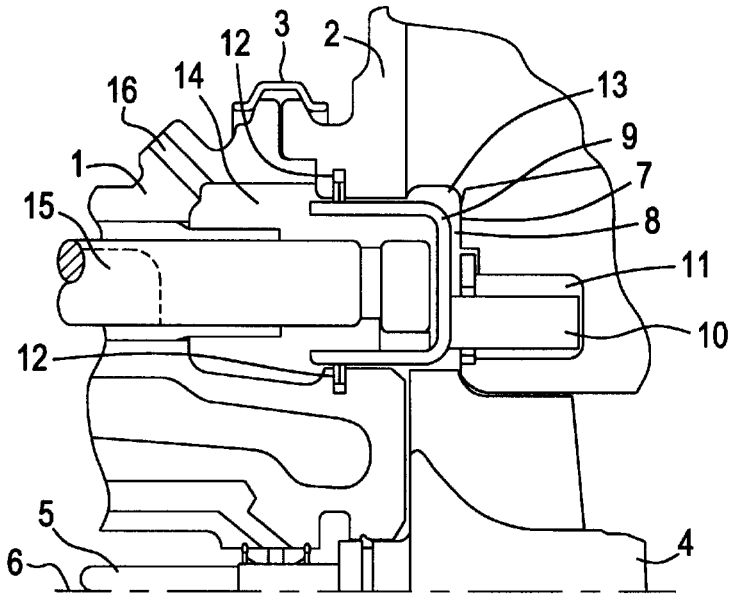
FIG. 1 is a sectional view of an upper half of a sidewall assembly of a variable geometry turbine, the sidewall being shown in a position in which a gas inlet passageway is of minimum width.
Figure 2:
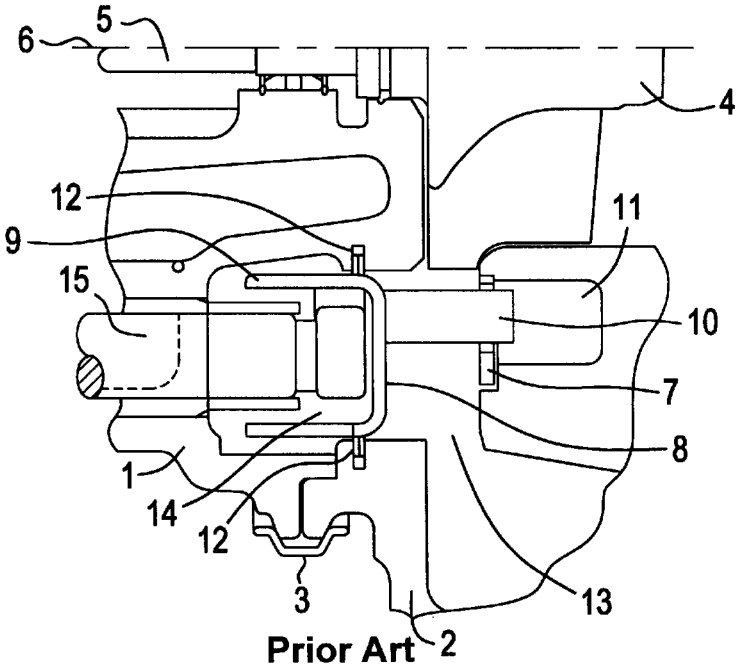
Prior Art FIG. 2
FIG. 2 shows the lower half of the sidewall assembly of FIG. 1 with the sidewall displaced to the fully open position.

Referring to FIGS. 1 and 2, the illustrated variable geometry turbine comprises a housing formed by a bearing housing 1 and a turbine wheel housing 2 clamped together with an annular clip 3, and a turbine wheel 4 mounted on a shaft 5 to rotate about an axis 6. The shaft 5 is supported on bearings within the bearing housing 1. The turbine housing 2 defines a surface 7 facing a surface 8 defined by a sidewall 9. The sidewall 9 in the illustrated assembly is formed from relatively thin steel and in cross-section is generally C-shaped, but it will be appreciated that the sidewall 9 could be for example a cast component. Vanes 10 mounted on the sidewall project from the surface 8 into an annular recess 11 defined in the housing. A sidewall which supports vanes as in the illustrated assembly is sometimes referred to as a "nozzle ring", but the term "sidewall" will be used herein.

Sealing rings 12 prevent gas flow between an inlet passageway 13 defined between the surfaces 7 and 8 and a chamber 14 located on the side of the sidewall remote from the vanes 10. Thus the sidewall 9 forms an annular piston received within an annular cylinder that defines the chamber 14. Support rods 15 on which the sidewall 9 is mounted extend into the chamber 14. An inlet 16 is formed in the bearing housing 1 to enable control of the pressure within the chamber 14. Increasing that pressure moves the sidewall 9 towards a fully closed position shown in FIG. 1, whereas reducing that pressure moves the sidewall 9 towards a fully open position as shown in FIG. 2.

Figure 3:
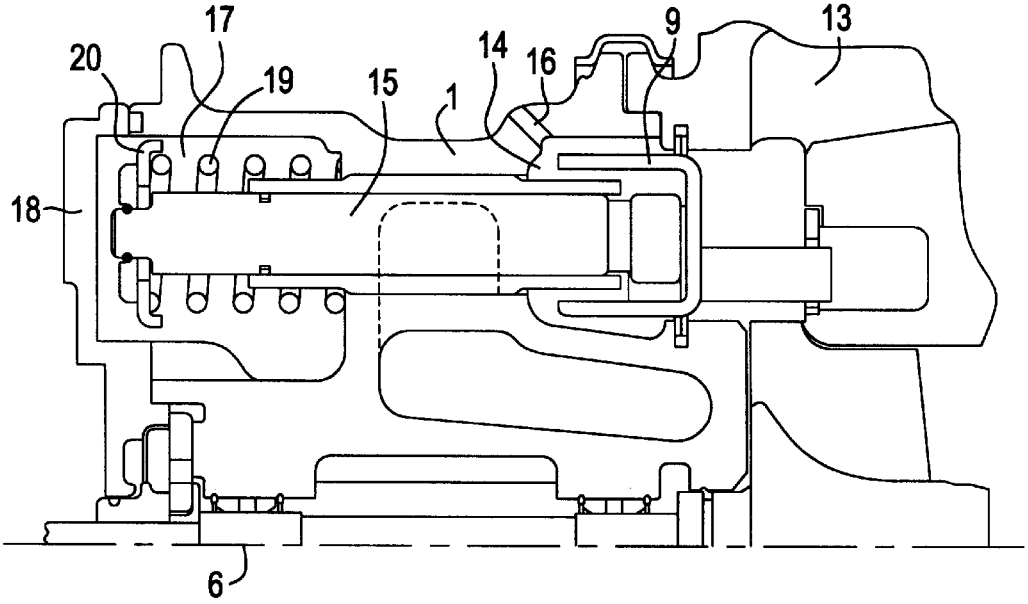
FIG. 3 shows a spring arrangement for the sidewall support rods of FIGS. 1 and 2.

Referring to FIG. 3, this illustrates one arrangement for spring-mounting the support rods 15 in the bearing housing 1. In the arrangement shown in FIG. 3, which corresponds to the sidewall 9 of FIGS. 1 and 2 in the fully open position, each support rod extends through a bore in the bearing housing 1 into a cavity 17. The cavity 17 is defined between the bearing housing 1 and a further housing component 18 coupled to the bearing housing 1. The pressure within cavity 17 is maintained close to atmospheric pressure.

The pressure within the chamber 14 is used to control the axial displacement of the sidewall 9. Means (not shown) are provided for controlling the pressure within the chamber 14 in accordance with a control program responsive to for example engine speed and torque and turbine pressures and temperature. The pressure control means is coupled to the inlet 16.

The rod 15 is biased towards the left in FIG. 3 by a compression spring 19 having a linear spring force characteristic compressed between the bearing housing 1 and a washer 20 retained on the end of the rod 15. Thus if the inlet passage 13 and the chamber 14 are vented to atmosphere, the rod 15 will assume the axial position shown in FIG. 3. If the pressure within the chamber 14 is then increased, the rod 15 and sidewall 9 will be displaced towards the right in FIG. 3 by a distance dependent upon the applied pressure.

Figure 4:
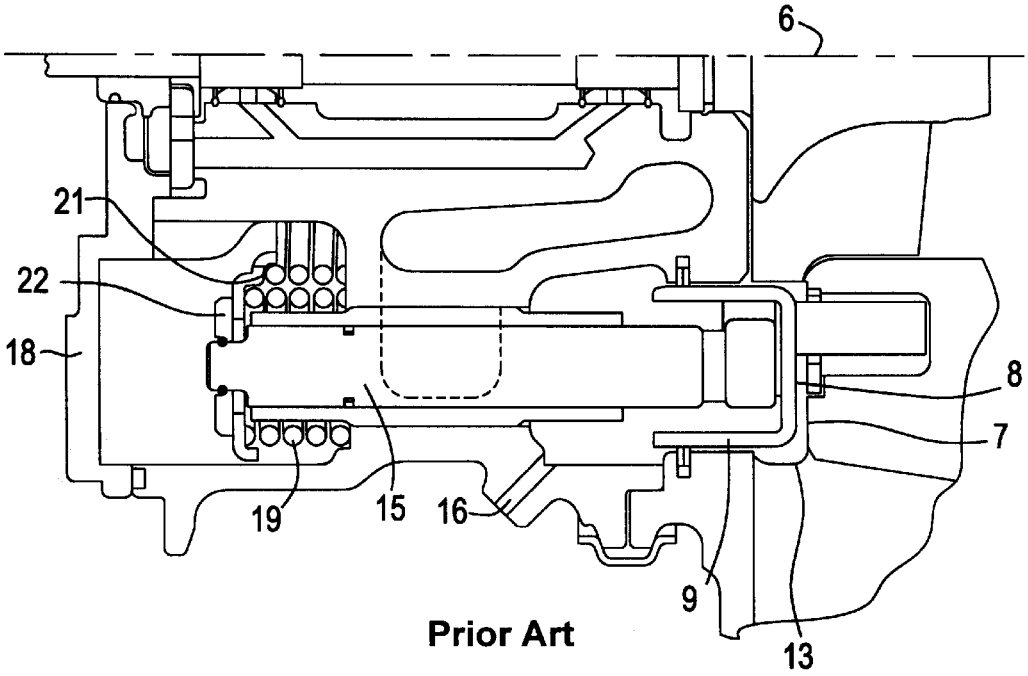
Prior Art FIG. 4
FIG. 4 shows a spring arrangement in accordance with the present invention for the sidewall support rods shown in FIGS. 1 and 2.

Referring now to FIG. 4, which illustrates an embodiment of the present invention, components equivalent to those described in FIG. 3 carry the same reference numerals. In the arrangement of FIG. 4 however it will be noted that a further compression spring 21 which is coaxial with the axis 6 bears against an annular support ring 22 which performs the same function as the washers 20 in the arrangement of FIG. 3. Each support rod 15 also extends through a coaxial compression spring 19. Thus the force driving the rod 14 to the left in FIG. 4 is the combination of the compression forces applied by the springs 19 and 21, and any axial forces applied to the sidewall 9 by the gas flowing through the inlet passage 13.

The springs 19 and 21 are arranged such that the return force applied to the rods 15 increases as the surface 8 of the sidewall 9 approaches the surface 7 defined by the turbine housing 2. For example, the spring 21 may have a length when in its relaxed state such that it does not oppose movement of the ring 22 to the right in FIG. 4 except when the sidewall 9 is relatively close to the surface 7. It has been found that this is an advantageous characteristic as the pressure within the inlet passage 13, which pressure acts on the surface 8, reduces as the surface 8 approaches the surface 7 due to the flow conditions within the gap defined between those two surfaces.

Figure 5:
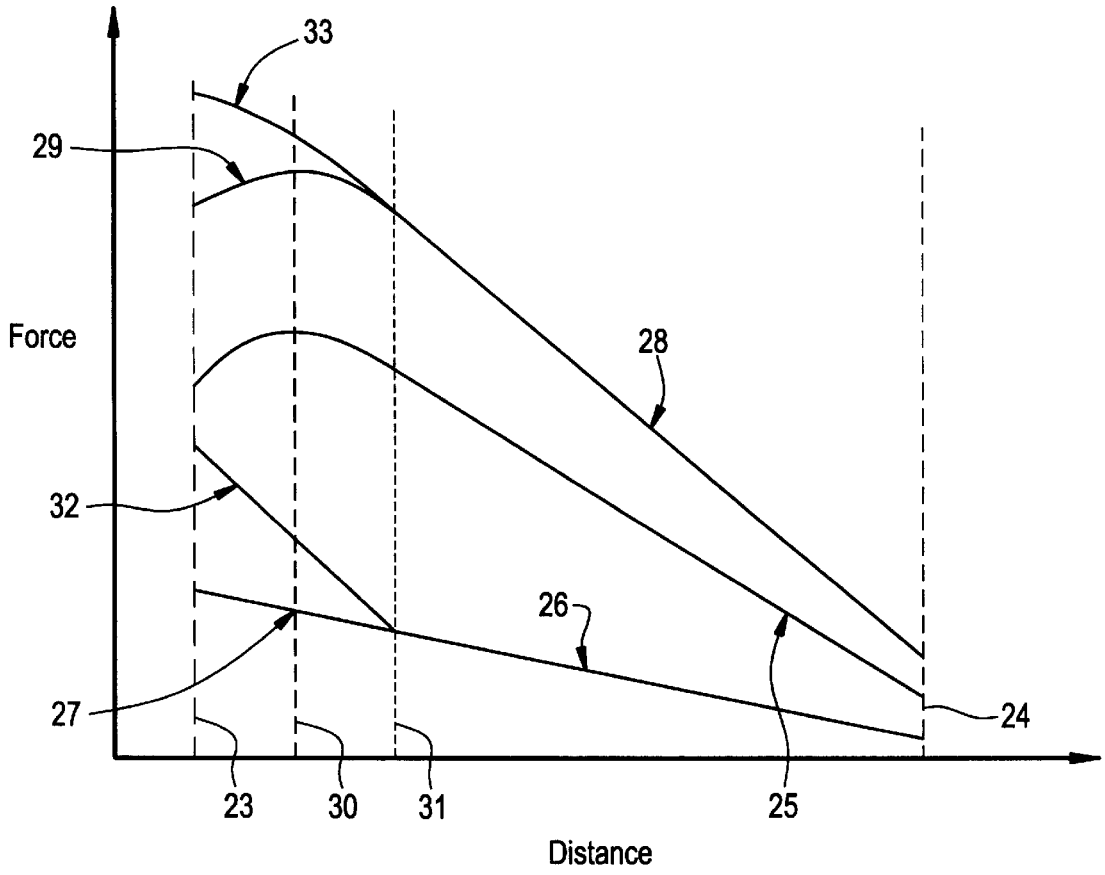
FIG. 5 is a schematic representation of the different characteristics of the spring assemblies of FIGS. 3 and 4 and the reactant gas force and resultant force on the sidewall with such assemblies.

FIG. 5 illustrates the operational differences between an arrangement such as that described with FIG. 3, in which the spring 19 has a linear spring rate, and the arrangement in accordance with present invention of FIG. 4 in which the combination of springs 19 and 21 provides a non-linear spring rate. In FIG. 5, the curves represent axial forces applied to the assembly of components including the sidewall 9 as the distance between the surfaces 7 and 8 (the inlet passage width) is increased from a minimum 23 (fully closed as shown in FIG. 1) to a maximum 24 (fully open as shown in FIG. 2).

Curve 25 of FIG. 5 represents the variation of axial force due to reactant gas forces on the surface 8 of the sidewall 9. It will be noted that as the passage width is reduced the reactant gas force initially rises in a substantially linear fashion but then falls as the sidewall 9 approaches the surface 7 of the turbine housing 2. The curves 26 and 27 represent the force applied by the spring 19 of FIG. 3. The curves 28 and 29 represent the resultant axial force on the sidewall 9, the resultant force reducing with reduction in passage width beyond the distance indicated by line 30. Thus with an arrangement as shown in FIG. 3 in which the springs 19 have linear characteristics, the axial position of the sidewall 9 is unstable when the inlet passage width is reduced to the limit represented by line 30. In particular, there will be a tendency for the sidewall to be moved rapidly to the minimum width position in an uncontrolled manner as soon as it passes the position represented by line 30.

With the arrangement of FIG. 4, the spring 21 has no effect when the inlet passage width is in the range represented by the distances between the lines 24 and 31. As soon as the passage width is reduced to the limit represented by line 31 however, further reductions in the passage width compress both the spring 21 and the springs 19. As a result the combined spring characteristic is as represented by lines 26 and 32, and the resultant is represented by lines 28 and 33. Thus the resultant of the spring and reactant gas forces increase continuously as the inlet passage width reduces to the minimum represented by line 23. Instability in the axial position of the sidewall 9 is thus avoided.

Figure 6A:
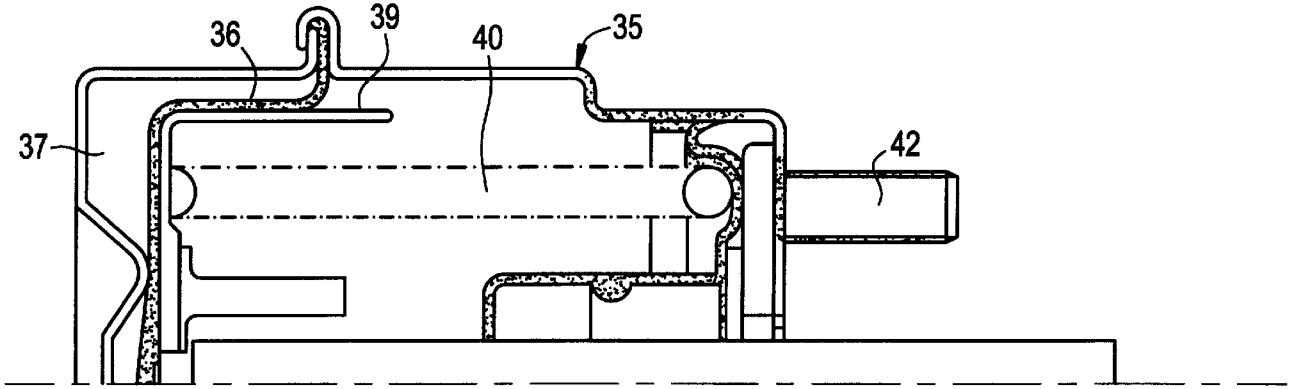
FIG. 6*a* is a sectional view representing an external actuator assembly for a sidewall support rod, the actuator having been modified in accordance with the present invention and shown in a retracted position.
Figure 6B:
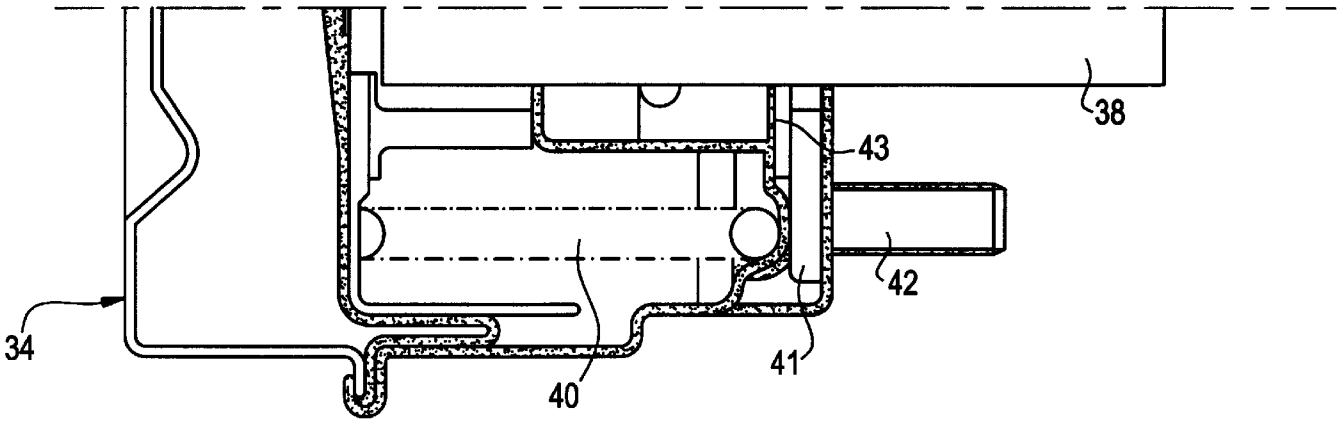
FIG. 6*b* is a sectional view of the external actuator assembly of FIG. 6*a*, but shown in an extended position.

Referring to FIGS. 6*a* & 6*b*, they illustrate in section an external actuator assembly which is of conventional structure except for the replacement by the conventional compression spring having linear characteristics by a compression spring having non-linear characteristics. A mechanism for interconnecting the actuator of FIG. 6 with control rods such as those shown in FIGS. 1 to 4 is described in for example U.S. Pat. No. 5,522,697 and is herein incorporated by reference.

Referring to FIG. 6*b*, the actuator is shown in its fully extended condition (corresponding to the position of an associated sidewall being fully closed as shown in FIG. 1) whereas FIG. 6*a* shows the actuator in its fully retracted position (corresponding to the associated sidewall being in the fully open position as illustrated in FIG. 2). The actuator comprises a cover defined by pressed steel components 35 between which the peripheral edge of a diaphragm 36 is clamped. A chamber 37 is shown on the left-hand side of the diaphragm 36 in FIG. 6 and gas under pressure is admitted to that chamber via an inlet (not shown) to control the axial movement of an actuator output rod 38 connected to a cup-shaped member 39 which bears against the side of the diaphragm 26 remote from the chamber 37. A compression spring 40 is received within the cover and bears at one end against the piston member 39 and at the other end against a clamping plate 41 from which studs 42 extend, the studs providing a convenient means for fixing the actuator to a support (not shown). A dust shield 43 limits the penetration of contaminant inside the cover.

In a conventional actuator, the compression spring 40 has a linear spring force to length relationship and hence exhibits the same control problems as illustrated in FIG. 5 with reference to the structure shown in FIG. 3. In accordance with the present invention however in the actuator of FIG. 6 the compression 40 has a non-linear characteristic to provide a performance equivalent to that delivered by the spring arrangement illustrated in FIG. 4. Such a non-linear spring characteristic can be achieved in any convenient manner for example by forming the compression spring 40 such that at one end turns of the spring come into contact with each other before turns at the other end of the spring. Other arrangements could of course be contemplated, for example, a compression spring which is generally conical rather than cylindrical as shown in FIG. 6.

Having described the invention, what is claimed as novel and desired to be secured by Letters Patent of the united states is:

1. A variable geometry turbine comprising a housing, a turbine wheel mounted to rotate about a predetermined axis within the housing, a gas inlet passage to the turbine defined between a fixed wall and an annular sidewall which is mounted in the housing and is displaceable relative to the fixed wall between axially spaced first and second positions, at least one spring biasing the sidewall away from the fixed wall towards the first position, and means for applying an axial force to the sidewall in opposition to the at least one spring to thereby control the axial position of the sidewall, wherein the said at least one spring has a non-linear length to spring force characteristics such that the resultant of the applied spring force and an axial force applied to the sidewall as a result of gas flow through the passage increases continuously as the sidewall is displaced from the first position to the second position.

2. A variable geometry turbine according to claim 1, wherein the rate of change of spring force with sidewall displacement increases as the sidewall is displaced from the first position to the second position.

3. A variable geometry turbine according to claim 2, comprising one or more springs each having a non-linear length to spring force characteristic.

4. A variable geometry turbine according to claim 2, comprising at least two springs each having a linear length to spring force characteristic, the springs being arranged such that the resultant force applied to the sidewall by the springs is non-linear.

5. A variable geometry turbine according to claim 4, wherein the sidewall is mounted on support rods extending parallel to the wheel axis, each support rod extending through and being acted upon by a respective compression spring.

6. A variable geometry turbine according to claim 5, wherein each support rod is acted upon by a further compression spring which is coaxial with the wheel axis.

7. A variable geometry turbine according to claim 1, further comprising support rods extending parallel to the wheel axis for supporting said sidewall, and a mechanism coupled to an actuator mounted outside the housing for acting on said support rod, the said at least one spring and the axial force applying means being defined by the actuator.

* * * * *